United States Patent [19]

Bamberger et al.

[11] Patent Number: 4,934,570

[45] Date of Patent: Jun. 19, 1990

[54] CONTAINER CLOSURE WITH BREAKAWAY PLUNGER AND DIFFUSING CONTAINER INCORPORATING THE SAME

[75] Inventors: Mark E. Bamberger, Lexington, Ky.; Jay T. Elston, Springfield, Ohio; Cyrus Mohandes, Troy, Ohio; Hermann Sterner, St. Paris, Ohio

[73] Assignee: Kardon Industries, Inc., Philadelphia, Pa.

[21] Appl. No.: 222,846

[22] Filed: Jul. 22, 1988

[51] Int. Cl.[5] ..... B67D 5/42

[52] U.S. Cl. ..... 222/386; 222/387; 222/490; 222/491; 222/565

[58] Field of Search ..... 222/386, 387, 490, 491, 222/386.5

[56] References Cited

U.S. PATENT DOCUMENTS

| | | | |
|---|---|---|---|
| Re. 32,127 | 4/1986 | Abner | 229/5.6 |
| 2,097,917 | 11/1937 | Frederick | 229/43 |
| 2,138,699 | 11/1938 | Hinze | 93/39.1 |
| 2,253,091 | 8/1941 | Plum | 229/51 |
| 2,393,347 | 1/1946 | Stuart et al. | 93/39.1 |
| 2,458,085 | 1/1949 | Ludwig | 222/386 |
| 2,551,002 | 5/1951 | Jennings | 222/386 |
| 2,554,639 | 5/1951 | Ryan et al. | 215/40 |
| 2,649,999 | 8/1953 | Burch | 222/386 |
| 2,866,308 | 12/1958 | Collins | 53/297 |
| 2,902,190 | 9/1959 | Hosler | 222/386.5 |
| 3,241,726 | 3/1966 | Chester | 222/490 |
| 3,356,935 | 11/1982 | Kamin | 222/1 |
| 3,597,298 | 8/1971 | Stengle, Jr. | 161/42 |
| 4,201,306 | 5/1980 | Dubois et al. | 220/5 R |
| 4,331,267 | 5/1982 | Duncan et al. | 222/386 |
| 4,373,646 | 2/1983 | MacEwen | 222/327 |
| 4,728,006 | 3/1988 | Drobish et al. | 222/181 D |

*Primary Examiner*—Joseph J. Rolla
*Assistant Examiner*—David H. Bollinger
*Attorney, Agent, or Firm*—Volpe and Koenig

[57] ABSTRACT

The invention relates to improved end closures for a dispensing container. One end closure is a nonmetallic thermoplastic plunger end closure which is comprised of a retaining member and a plunger member which are connected along a fragmentation line. The plunger end closure is assembled to the container body by the retaining member during shipment. Upon use, the plunger is separated from the retaining member along the fragmentation line. The other end closure is a diffusing end closure for dispensing and diffusing material from the container. The diffusing end closure is comprised of a ring member which is affixed to the container and a diffusion disk which is bonded to the ring member. The diffusing disk includes at least three diffusing orifices.

7 Claims, 2 Drawing Sheets

FIG. 1
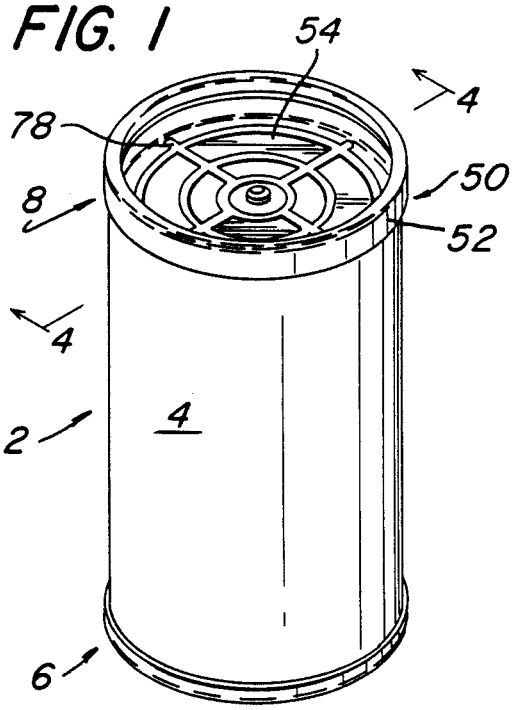
FIG. 2
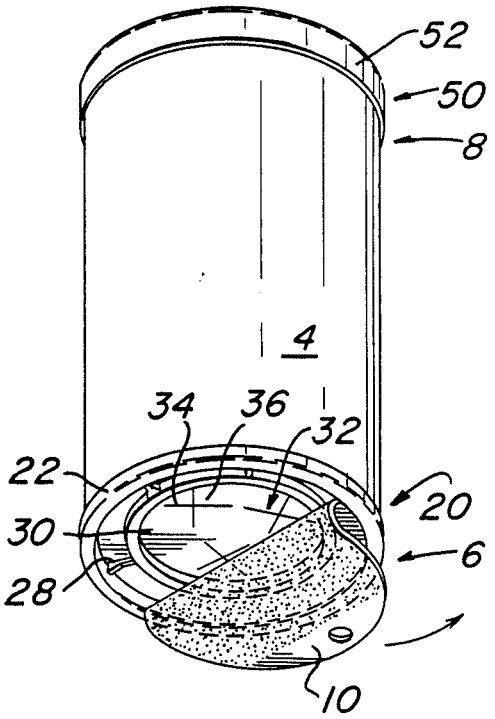
FIG. 3
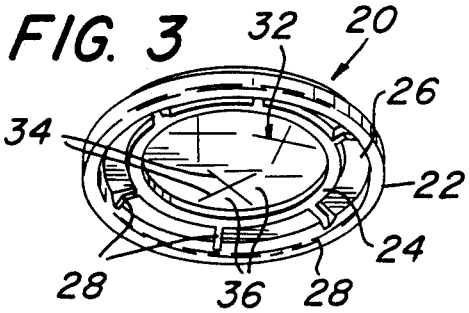
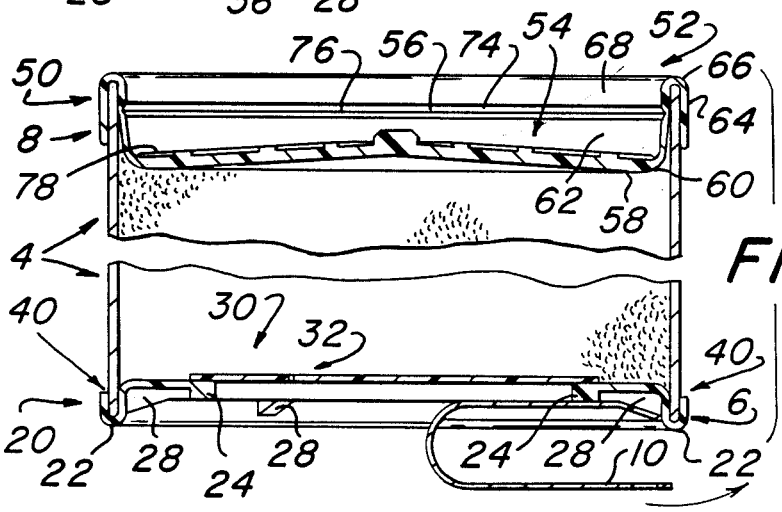
FIG. 4

CONTAINER CLOSURE WITH BREAKAWAY PLUNGER AND DIFFUSING CONTAINER INCORPORATING THE SAME

BACKGROUND OF THE INVENTION

1. Field of the Invention

The invention relates to a dispensing container which utilizes a plunger to urge the contents out of the container. In particular, the invention relates to dispensing containers as used in the fast food service industry.

2. DESCRIPTION OF THE PRIOR ART

The prior art includes food dispensing containers utilizing spiral wound and cut container bodies and plastic container bodies which are molded or extruded and cut. Likewise, the prior art includes open ended containers having a plunger affixed to one end and a dispensing end closure affixed to the second end thereof.

The prior art attempts to provide a dispensing container assembly have met with some success. However, it was felt that there was a continuing need for a unitary or integral plunger and end closure assembly which eliminated the need for separate end closure elements while continuing to provide the necessary seal against liquid seepage. In addition, it was felt that there was a continuing need to provide a dispensing end closure which was relatively simple in construction but had improved dispensing characteristics.

U.S. Pat. No. 4,373,646, issued to George E. MacEwen on Feb. 15, 1983, discloses a prior art attempt to provide simplified end closures and a simplified container construction.

SUMMARY OF THE INVENTION

The present invention relates to a plunger end closure, a dispensing end closure, and a container utilizing one or both of the closures.

The unitary plunger closure includes a ring portion having an internal cavity which receives the container body, a fragmentation line which is integral with the ring portion and a plunger which is integral with the fragmentation line and may be ruptured from the fragmentation line when the container is placed in use.

The dispensing closure comprises an outer ring having a cavity to receive the container body, and an inner ring connected with the outer ring by a generally planar segment. The inner ring defines an interior opening through the closure. A dispensing disk is secured to the inner ring and closes the interior opening. The dispensing disk has multiple dispensing orifices within the area of the interior opening defined by the inner ring.

The dispensing container comprises a hollow tube body. At either end of the body, a closure is affixed to close the body. In the preferred embodiment, one end closure includes a plunger portion which may be used to urge product from the container. At the other end of the preferred embodiment, a dispensing closure is used. The dispensing closure provides improved diffusion of the product through the multiple orifices.

BRIEF DESCRIPTION OF THE DRAWINGS

FIG. 1 is a perspective view of a completed container in accordance with the invention and embodies both the plunger closure and the dispensing closure of the invention.

FIG. 2 is a perspective view of the invention showing the details of the dispensing end of the container.

FIG. 3 is a perspective view of the dispensing closure of the invention.

FIG. 4 is a fragmentary section through the line 4—4 of FIG. 1, showing the details of the container of FIG. 1.

DETAILED DESCRIPTION OF THE PREFERRED EMBODIMENTS

Figure 5:
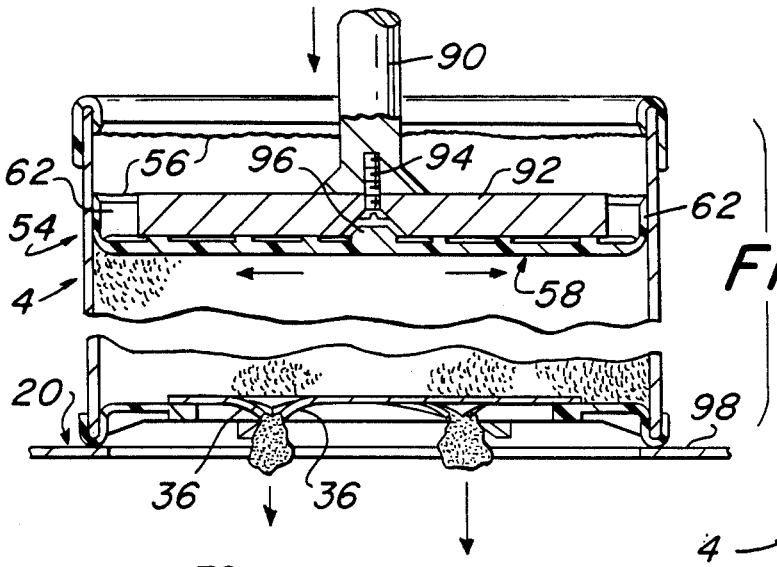
FIG. 5 is a fragmentary section, similar to that of FIG. 4, showing the details of the container in use during a dispensing operation with the plunger fragmented from the retaining ring.

With respect to FIG. 1, there is shown a completed container 2 having a body portion, 4 a first end, 6 and a second end, 8. As will be recognized by those skilled in the art, the container as shown in FIG. 1 is a closed container as used in shipping goods. In the current application, the preferred goods are sauces or dressings which are dispensed at fast food locations. The container is supplied to the food stuff manufacturer with the body portion 4 and one end, usually end 6, in an assembled condition. The container is filled with the desired goods and the second end 8 is closed, such as by application of the end closure 50, for shipment.

Since product is normally dispensed downwardly, the first end 6 will be referred to as the dispensing end and the second end 8 will be referred to as the plunger end.

With reference to FIGS. 2 and 3, the container 2 is shown in the position of use for dispensing the food stuffs. A sanitary seal 10, shown in a partially removed condition, is provided to prevent cOntamination of the dispensing end closure 20. As can be seen with reference to FIG. 4, the dispensing end closure 20 comprises a first outer ring 22, a second, concentric inner ring 24 and an integral planar portion 26 having a plurality of reinforcement ribs 28, preferably about six, equally spaced and disposed between the concentric rings. A central dispensing disk 30 is secured on the interior of inner ring 24 and closes the circular opening defined by the inner ring 24.

The central dispensing disk 30, preferably, has three orifices 32. Each orifice 32 is comprised of cross-hair like slits 34 which produces the petals 36. In the preferred embodiment, the center of each orifice 32 lies on a circle having a radius of between $\frac{5}{8}$ to $\frac{3}{4}$ of an inch from the center of the disk 30. Each leg of the cross-hair slits is about 9/32 of an inch long and the legs are at right angles to each other. In the preferred embodiment, there are six ribs 28, and each orifice is positioned so that the outer most pedal 36 has its base disposed toward the circumference of the disk 30.

With reference to FIG. 4, the construction of the dispensing end closure 20 will be more fully explained.

As can be seen from FIG. 4, the disk 30 is mounted, generally by a heat sealing operation, on the interior of the dispensing end closure 20 and is affixed to the interior of the concentric ring 24. The multiple orifices provide an improved diffusion pattern for the dispensed material. In addition, the multiple orifices provide a better distribution of the dispensing forces across the entire surface of the disk 30. Accordingly, disk 30 is not subjected to maximum pressure through a single orifice.

Presently, it is preferred that the disk 30 be produced in a die cutting operation from sheet material. A polyester material laminated with a heat sealable coating is presently utilized. One suitable material is 0.004" polyester laminated to 0.002" polyethylene and is available from American-National Can.

From FIG. 4, it can be seen that the outer ring 22 includes a generally U" shaped cavity 40. As will be recognized by those skilled in the art, cavity 40 is dimensioned to receive an end of body 4 and to seal the dispensing end 6 against leakage. Unlike some prior art closures, the closure 20 does not require a separate member for affixation to the body 4. The closure may be sized to achieve an interference fit with the body 4; however, in the preferred embodiment the closure is positively sealed body 4. Sealing is achieved by application of an adhesive to the inside edge of the body 4 prior to assembly or by thermal bonding after assembly. Thermal bonding may be achieved by sonic welding, heat sealing or spin welding techniques. It will be understood by those skilled in the art that the sealing technique utilized will depend, to a certain degree, upon the materials selected for the closure 20 and the body 4. Thus, the end closure 20 provides a unitary dispensing and attachment means.

With reference to FIG. 4, the end closure 50 for end 8 will be further described. The end 8 is sealed by an end closure 50 which comprises an outer ring portion 52 and an inner plunger portion 54. The outer ring portion 52 and inner plunger 54 are integrally connected by a fragmentation line 56 and are formed as a unit, preferably by injection molding. The ring portion 52 generally resembles an inverted J. During shipping the ring portion 52 and plunger portion 54 combine to seal the container. The ring portion 52 locates the plunger in proper position with respect to the filling level of the contents and seals with the end of the container. This sealing will be discussed in more detail with respect to FIGS. 7, 8 and 9. The plunger portion 54 is connected along the thinned fragmentation line 56 of the interior wall and is broken away from the ring portion when the container is placed in service.

With reference again to FIG. 4, end closure 50, prior to use, is comprised of a retainer means or ring portion 52 and a plunger portion 54 which are integrally connected by the fragmentation line 56. Ring portion 52 is comprised of an exterior member or leg 64 and an interior member or leg 68 which are integral with an external radius 66. The exterior leg 64 is typically about 0.045 inches thick and about 0.380 inches long, the external radius 66 has a typical exterior radius of about 0.068 inches and the interior leg 68 has a typical length, from the radius to about the fragmentation line 56, of about 0.155 inches and a thickness of about 0.060 inches. As a result of this construction, an interior cavity 6 is established between the inner surfaces of the external leg 64 and t he interior leg 68. Typically, the interior cavity 69 will define a slot of about 0.031 inches. This cavity is dimensioned so as to receive the preferred container body 4 in an interference fit. It will be understood by those skilled in the art that the interior cavity 69 may be varied in accordance with the thickness of the container body 4. The fragmentation line 56 has a typical thickness of 0.003 inches. As can be seen from FIG. 8, the interior leg 62 is tapered at 74 and the plunger side wall 62 is tapered at 76 toward the fragmentation line. Tapers 74 and 76 are believed to be an advantage in controlling the thickness of the fragmentation line 56 during molding and assist in forming the break line when the plunger is released.

Returning to FIG. 4, the plunger portion 54 will be described in more detail. Plunger portion 54 is comprised of a plunger disk 58, an internal integral radius 60 and a plunger side wall 62. As can be seen from FIG. 4, the plunger portion is preferably molded so as to be normally convex. In a typical embodiment of the body 4, the plunger as shown in FIG. 4 will have a maximum exterior diameter of 3.125 inches. It will be understood that the plunger diameter is related to the interior of the body 4 and will be sized accordingly. The plunger disk 58, in this embodiment, is molded so that its interior center point is approximately 0.125 inches above the plane defined by the lower surface of the plunger disk 58. The side wall of plunger 62 is typically tapered from a thickness of about 0.034 inches adjacent the taper 74 to a thickness of 0.040 inches adjacent the radius 60. In general, side wall 62 will terminate at a point which is about equal to the free end 80 of exterior leg 64. The internal radius 60 will typically have an inner radius of about 0.116 inches and an outer radius of about 0.160 inches. The plunger 58 will preferably have a minimum thickness of about 0.040 inches with a thickness of about 0.052 inches in the area of the concentric rings and ribs generally designated as 78 in FIGS. 1 and 4. The purpose for the convex shape of the plunger disk 58 will be discussed hereinafter with respect to assembling and use of the invention.

Figure 7:
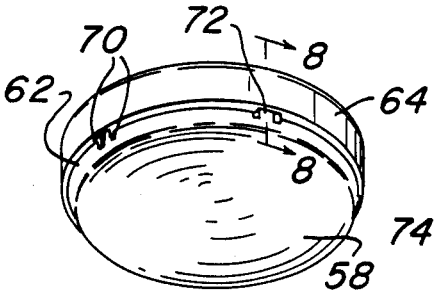
FIG. 7 is a perspective view of the plunger end closure of the invention.
Figure 8:
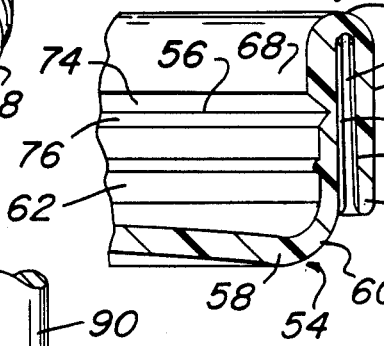
FIG. 8 is a fragmentary section taken through the line 8—8 of FIG. 7 and shows the construction of the plunger end closure in detail.
Figure 9:
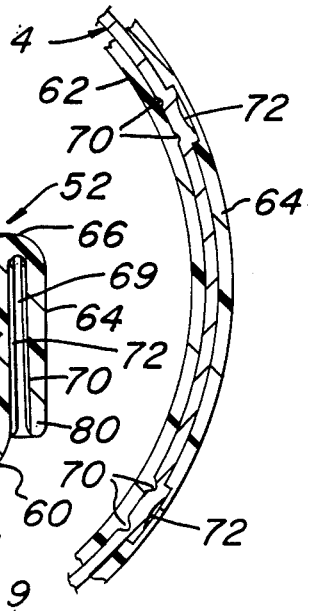
FIG. 9 is a fragmentary section taken through the line 9—9 of FIG. 6 and shows a enlarged detail of the construction of the container body and the plunger end closure.

With respect to FIGS. 7 , 8 and 9, the construction of the closure 52 will be further described. As can be seen from FIG. 7, the interior walls of interior leg 68 and plunger side wall 62 are provided with two continuous protrusions 70. These protrusions are disposed opposite to a recess 72 which is formed in the interior wall of external leg 64. In the preferred embodiment, there are six sets of protrusions and recesses equally spaced around the circumference of the closure 52. Referring to FIGS. 8 and 9, it can be seen that the protrusions 70 and recess 72 cooperate as a mechanical means to compress the body 4 in a crimping fashion.

As a result of the interference fit within cavity 69 and the crimping action of protrusion 70 and recesses 72, there is no further need for additional means to secure the end closure and plunger assembly 50 to the container body 4. Further purposes for the protrusions and recesses will be discussed hereinafter.

With respect to both end closures, they are preferably molded. In the case of the dispensing end closure 20, one suitable material is low density polyethylene number 3029 which is available from Quantum Chemical Co., 11500 N. Lake Drive, Cincinnati, Ohio 45249. With respect to the plunger end closure 50, one suitable material is high density polyethylene, DMDA8965, available from Union Carbide. At present, it is preferred to injection mold both parts. This is particularly true with respect to plunger end closure 50 and the formation of the mechanical means, 70, 72, to secure the closure to the container body. However, it is envisioned that the parts, particularly closure 20 could be produced as a thermoformed component.

With reference to FIG. 4, the current method of securing the disk 30 to inner ring 24 is conduction heat sealing. In this method the disk 30 and ring 24 are aligned and subjected to about 375° F. at a pressure of about 45 psi for a duration of about 0.6 seconds. It will be recognized by those skilled in the art that other methods of bonding may be utilized and that the method(s) selected will be compatible with the materials of disk 30 and ring 24 and the intended end use.

With reference to FIG. 4, assembly of the container will be explained. As indicated previously, the container body 4 is secured to the dispensing end closure 20 at the cavity 40. Although this could be an interference fit, it is presently preferred to provide additional securing means. The additional securing means is preferred based upon the fact that the dispensing end will be under the greatest pressure when the container is in use. As is known by those skilled in the art, food stuffs are dispensed from containers of the type disclosed herein by mechanical means which are very similar to caulking guns. In most instances, the dispensing apparatus is hand operated. However, in some instances, the dispensing apparatus is an automated device which dispenses aliquot portions of the food stuffs. One hand held device for dispensing food stuffs from a container of the type disclosed herein is described in U.S. Pat. No. 4,373,646. Such a hand held dispensing mechanism is suitable for use with the present invention. If one were to use a dispensing mechanism as disclosed in U.S. Pat. No. 4,373,646, it may not be necessary to utilize additional means for securing the dispensing end closure 20 to the container body. In that device, as disclosed, a full forward wall is provided against which the dispensing end of the container rests so that the pressure applied by the trigger mechanism would not result in dislodgment of the dispensing end closure 20.

Assuming that the end closure 20 has been assembled with the body 4, the container is then filled to the desired level with the food product. At that point, the end closure 50 is assembled to the body 4. In assembling the end closure 50, it is preferred that the convex center of the plunger 58 be deflected inwardly so as to be slightly concave as the closure 52 is assembled to the body 4. Since the plunger disk 58 and the radius 60 extend below the side wall 62 and exterior leg 64, air will be able to escape around the advancing plunger as it enters the body 4. As the plunger portion enters the container in this configuration, its maximum diameter is slightly increased and the leading edge of the side wall 62 is bought into sealing contact with the interior of the body 4. This can be seen with reference to FIG. 5. Air which is purged from the container is permitted to escape through the vent formed through the cooperation of protrusions 70 and recesses 72. In this manner, the air will be purged as the body 4 is moved into abutment with the interior of radius 66. When the body 4 has abutted the interior of radius 66, substantially all of the entrapped air will have been purged. The ingress of air will then be blocked as a result of the seal which is established between wall 62 and interior leg 68 with the interior of the body 4.

When the closure 52 is fully assembled to the body 4, the plunger disk 58 will return to its concave configuration, as shown in FIG. 4 and will assert a slight upward pull on the food stuff within the container. This configuration produces a slight negative pressure within the container and serves to relieve pressure from the dispensing end closure 20.

Figure 6:
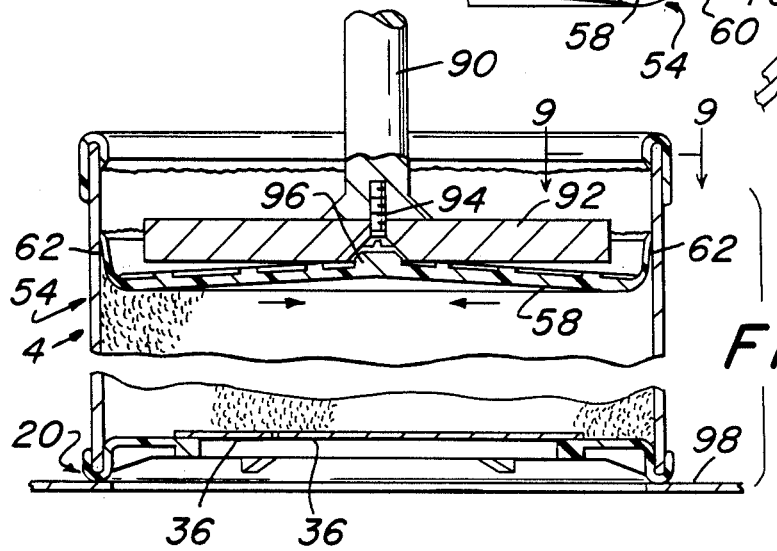
FIG. 6 is similar to FIG. 5 and shows the plunger configuration after cessation of the dispensing operation as shown in FIG. 5.

With reference to FIGS. 5 and 6, use of the dispensing container will be described. In general, the currently used mechanical dispensing means will have a rod or shaft 90 which is progressively moved by the dispensing mechanism. A disk 92 is secured to the shaft 90 by an attachment means, such as screw 94; the disk 92 has a slight recess 96 in which the screw 94 is positioned to avoid abrasion of the plunger 58. In the present embodiment, the plunger disk 58 has a small molding dimple which is easily received within the recess 96. As pressure is applied to the shaft 90, disk 92 engages the upper surface of plunger disk 58 and progressively decreases the convex disk to a planar disk as shown in FIG. 5. As a result of this depression, the disk is increased slightly in size and the plunger side walls 62 are urged outwardly as indicated by the arrows in FIG. 5. This outward movement increases the wiping and sealing qualities of the plunger side walls. As a result of the normal pressure asserted by the dispensing mechanism, the fragmentation line 56 is ruptured and the plunger portion 54 is freed for downward movement and dispensing of the food stuff. FIG. 5 illustrates the invention with the sanitary seal lo removed and the container abutting a forward retaining means 98 in the dispensing device. As the plunger portion 54 is urged downwardly, the product will be urged against the pedals 36 of dispensing end closure 2o and the product will be dispensed. When sufficient product has been dispensed, shaft 90 will no longer be urged forward.

As can be seen with reference to FIG. 6, the cessation of pressure applied by shaft 9o will halt the dispensing of the product. The pedals 36 will return to their original position and will seal the respective orifice 32. The plunger disk 58 will return to its normal convex configuration and the side wall 6z will move to their normal at rest configuration as indicated by the arrows in FIG. 6. As a result of this configuration, a slight negative pressure is created. This slight negative pressure prevents unwanted dripping of food stuff and provides a positive shut off to product dispensing. In addition, the slight convex configuration of the plunger disk 58 will draw the product from the edges of the disk toward the center. This tends to minimize the likelihood that food stuff will become lodged between the side wall 62 and the container body 4 and interfere with the sealing and wiping action of the plunger 54 in subsequent dispensing operations.

We claim:

1. A unitary nonmetallic, thermoplastic closure and plunger assembly for closing one end of an open ended hollow body tube, said assembly comprising:

a retainer means having external and internal members, which define a cavity that receives one end of said body tube in non-crimped sealing engagement, a fragmentation line which is integral with the internal member of the retainer means, and a concave plunger portion which is internal with and depends from the fragmentation line.

2. A nonmetallic, thermoplastic unitary container closure and plunger assembly for non-crimped closing of one end of an opened ended container, said assembly comprising:

a ring portion having external and internal legs which define an internal cavity that sealing engages the container, a fragmentation line which is integral with the internal leg of the ring portion, and a concave plunger portion which is internal with and depends from the fragmentation line said plunger portion sized to fit within the end of the container in wiping engagement with the container interior when the concave portion is moved into a common plane.

3. A unitary container closure and plunger assembly formed of nonmetallic thermoplastic material, said assembly comprised of:

a ring portion having external and internal members which define a cavity, a fragmentation line which is integral with the internal member of the ring portion, and a plunger portion which is internal with and depends from the fragmentation line, said plunger portion having a first concave configuration and a second non-concave configuration, said plunger having a first external diameter in the concave configuration which is less than the diameter of the internal member and a second external diameter in the non concave configuration which is substantially equal to the external diameter of the internal member.

4. A dispensing container assembly comprising:

a hollow body having at least one open end and a dispensing end opposite said open end, and a unitary nonmetallic thermoplastic plunger closure assembly affixed without crimping to said open end, said plunger closure assembly further comprising:

a retainer means having external and internal members which define an attachment cavity for securing said plunger closure to the open end of said body without crimping of either the external and/or internal members, a fragmentation line which is integral with the internal member of the retainer means, and a concave plunger portion which is integral with and depends from the fragmentation line into said body.

5. A dispensing container assembly comprising:

a hollow open ended body, a unitary nonmetallic thermoplastic plunger closure affixed to one open end of said body, said plunger closure further comprising:

a ring portion having external and internal legs which define an internal cavity, a fragmentation line which is integral with the internal leg of the ring portion, and a plunger portion which is integral with and depends from the fragmentation line said plunger portion having a central element which has a concave configuration in its relaxed state and a planar configuration in its plunging state; and a dispensing closure affixed to the other open end of said body.

6. A dispensing container assembly comprising:

a hollow open ended tubular body, a unitary nonmetallic plunger closure affixed to one open end of said body, said plunger closure further comprising:

a ring portion having external and internal legs which define an internal cavity, a fragmentation line which is integral with the internal leg of the ring portion, and a plunger portion which is integral with and depends from the fragmentation line; and a dispensing closure affixed to the other open end of said body, said dispensing closure further comprising:

an outer ring having an internal cavity, a circular intermediate portion integral with outer ring and extending inwardly, an inner ring integral with the interior circumference of said intermediate portion and defining an interior opening, and a dispensing disk secured to said inner ring and closing said interior opening, said dispensing disk having at least three dispensing orifices in an area which is no greater than the area of the interior opening defined by the inner ring, said dispensing orifices each defining a petal and together forming a diffuse pattern of the dispensed material.

7. A dispensing container assembly comprising:

a hollow open ended tubular body, a unitary nonmetallic plunger closure affixed to one open end of said body, said plunger closure further comprising:

a ring portion having external and internal legs which define an internal cavity, a fragmentation line which is integral with the internal leg of the ring portion, and a plunger portion which is integral with and depends from the fragmentation line and has a concave configuration in a relaxed state that defines an external diameter which is substantially equal to the tubular body's internal diameter and a planar configuration in a plunging state that defines an external diameter which is at least equal to the tubular body's internal diameter; and a dispensing closure affixed to the other open end of said body.

* * * * *